United States Patent [19]

Petronella

[11] Patent Number: 4,518,395

[45] Date of Patent: May 21, 1985

[54] PROCESS FOR THE STABILIZATION OF METAL-CONTAINING HYDROCARBON FUEL COMPOSITIONS

[75] Inventor: Joseph Petronella, Old Bridge Township, Middlesex County, N.J.

[73] Assignee: Nuodex Inc., Piscataway, N.J.

[21] Appl. No.: 420,667

[22] Filed: Sep. 21, 1982

[51] Int. Cl.[3] ..... C10L 1/22

[52] U.S. Cl. ..... 44/53; 44/57; 44/56; 44/68; 252/386; 252/407

[58] Field of Search ..... 44/53, 68, 56, 57; 252/386, 389 R, 389.53

[56] References Cited

U.S. PATENT DOCUMENTS

| | | | |
|---|---|---|---|
| 2,445,778 | 7/1948 | Hale | 44/53 |
| 3,030,195 | 4/1962 | Ewan | 252/386 |
| 3,355,270 | 11/1967 | Amick et al. | 44/57 |
| 4,378,973 | 5/1983 | Sweeney | 44/57 |
| 4,397,654 | 8/1983 | Hart | 44/57 |

FOREIGN PATENT DOCUMENTS

| | | | |
|---|---|---|---|
| 7413839 | 1/1975 | Netherlands | 44/53 |

*Primary Examiner*—William R. Dixon, Jr.
*Assistant Examiner*—Margaret B. Medley
*Attorney, Agent, or Firm*—James P. Scullin

[57] ABSTRACT

A hydrocarbon fuel composition containing from 5 ppm to 500 ppm of a metal that normally catalyzes oxidative deterioration of said fuel composition is stabilized by incorporating in it from 1% to 25% by volume of a stabilizer that is an alkanol having 1 to 10 carbon atoms, a glycol having 2 to 9 carbon atoms, or a mixture thereof.

10 Claims, No Drawings

PROCESS FOR THE STABILIZATION OF METAL-CONTAINING HYDROCARBON FUEL COMPOSITIONS

This invention relates to a process for the stabilization of metal-containing hydrocarbon fuel compositions against oxidative deterioration and to the stabilized fuel compositions prepared by this process. More particularly, it relates to a process for the inhibition of gum formation in hydrocarbon fuel compositions that contain minor amounts of metals that have a detrimental effect on the stability of the composition.

Hydrocarbon fuel compositions, such as diesel fuel and gasoline, often contain amounts of oil-soluble and/or oil-dispersible metal compounds, especially copper compounds, that have a catalytic effect on oxidation reactions that occur when the fuel composition comes into contact with air. The metal compounds may be present as the result of treatment of the fuel with a metal-containing reagent, or they may be contaminants that result from contact of the fuels with various metals in the course of refining, storing, and shipping operations. When they are maintained at elevated temperatures in the presence of oxygen, these fuel compositions tend to decompose with the formation of gums, sludge, and other carbonaceous materials. These decomposition products are then deposited on the walls or in small passages of the fuel system causing their malfunction. This necessitates frequent cleaning and replacement of parts, thus markedly decreasing the performance efficiency of the equipment.

It is known in the art that distillate fuel compositions containing polyvalent metals, especially copper, can be stabilized by deactivating the metals by complexation with amines phenols, aminophenols, and the like. These complexing materials are expensive relative to the cost of the fuel and can therefore only be used economically when the concentration of metal in the fuel composition is very low, generally less than 10 ppm.

In accordance with this invention, it has been found that the stability of metal-containing hydrocarbon fuel compositions that tend to form insoluble gums when subjected to oxidative conditions can be improved substantially by incorporating in the fuel compositions a stabilizing amount of certain monohydric or dihydric alcohols. These stabilizers reduce the tendency of the compositions to undergo gum formation or other deterioration during oxidation of the fuel without increasing the cost of the fuel composition appreciably, regardless of its metal content.

While the exact mechanism by which the alcohol stabilizers inhibit the formation of insoluble gum in hydrocarbon fuel compositions is not fully understood at this time, it is believed that they reduce gum formation in the following ways: the alcohols are preferentially oxidized before these components of the fuel whose oxidation products include unsoluble gums, and the alcohols tend to solubilize any gum that is formed before the combustion of the fuel composition.

The hydrocarbon fuel compositions that may be stabilized by the process of this invention comprise petroleum distillates produced by the thermal or catalytic cracking of certain petroleum feed stocks. They include furnace oils, diesel fuels, jet engine fuels, kerosene, gasoline, and the like. These hydrocarbon fuel compositions contain from 5 ppm to 500 ppm, and in most cases from 30 ppm to 100 ppm, of a dissolved or dispersed metal compound that normally has a detrimental effec on the stability of the fuel composition. The metal in the fuel composition may be, for example, a copper, manganese, bismuth, nickel, lead or iron compound or a mixture thereof.

The stabilizers of this invention include alkanols having from 1 to 10 carbon atoms, glycols having from 2 to 9 carbon atoms, and mixtures thereof. The preferred stabilizers are alkanols having 1 to 4 carbon atoms glycols having 4 to 8 carbon atoms, and mixtures thereof. The following compounds are illustrative of the alcohols that are effective stabilizers for hydrocarbon fuel compositions: methanol, ethanol, propanol isopropanol, n-butanol, tert. butanol, n-hexanol, isoheptanol, n-octanol, 2-ethylhexanol, n-decanol, ethylene glycol, propylene glycol, trimethylene glycol, butanediol-1,4, butanediol-1,3, butanediol-2,3, pentanediol, methylpentanediol, dipropylene glycol, and tripropylene glycol.

The amount of the stabilizer that is used to inhibit gum formation is dependent to a large extent upon the type of fuel composition that is to be stabilized and the metal content of the fuel composition. It is usually in the range of from 1% to 25% by volume, with 2% to 10% by volume of the stabilizer preferably used when the fuel composition contains from 30 ppm to 100 ppm of copper or another metal that catalyzes oxidative deterioration of the fuel composition.

In addition to the hydrocarbon fuel, dissolved copper or other polyvalent metal, and stabilizer, the compositions of this invention may contain such additives as detergents, drying agents, lead-scavenging agents, alkyl-lead antidetonants, dyes, antioxidants, rust preventives, and the like in the amounts ordinarily employed for the purposes indicated.

The invention is further illustrated by the examples that follow.

EXAMPLE 1

A series of tests was carried out to determine the effectiveness of alcohols in inhibiting gum formation in a diesel fuel that contained 32 ppm of copper.

In these tests, copper-containing diesel fuel to which an alcohol stabilizer had been added was heated at 95° C. in the presence of oxygen for 16 hours, cooled, and filtered to remove insoluble gum from the fuel composition. This method is described in detail in ASTM D 2274-74.

The alcohols used as stabilizers and the results obtained are set forth in Table I. For comparative purposes, a similar test was carried out using the copper-containing diesel fuel in the absence of an alcohol stabilizer.

When the test was repeated using metal-free diesel fuel and no alcohol stabilizer, 0.2 mg./100 ml. of gum was formed.

TABLE I

Stabilization of Diesel Fuel Containing 32 ppm of Copper

| Ex. No. | Stabilizer: Alcohol | Stabilizer: Amount of Alcohol (% by Volume) | Gum Formation (mg./100 ml.) |
|---|---|---|---|
| 1A | Methanol | 1 | 10.7 |
| | Isopropanol | 1 | |
| 1B | Methanol | 1 | 4.2 |
| | Ethanol | 4 | |
| 1C | Ethanol | 10 | 2.5 |
| Comp. | — | — | 24.5 |

TABLE I-continued

| | Stabilization of Diesel Fuel Containing 32 ppm of Copper | | |
|---|---|---|---|
| | Stabilizer | | |
| | Alcohol | Amount of Alcohol (% by Volume) | Gum Formation (mg./100 ml.) |
| . A | | | |

EXAMPLE 2

The procedure of Example 1 was repeated using a esel fuel that contained 77 ppm of copper. The results tained are set forth in Table II.

TABLE II

| | Stabilization of Diesel Fuel Containing 77 ppm of Copper | | |
|---|---|---|---|
| | Stabilizer | | |
| | Alcohol | Amount of Alcohol (% by Volume) | Gum Formation (mg./100 ml.) |
| | Isopropanol | 5 | 23.0 |
| | n-Butanol | 5 | 52.0 |
| | 2-Methyl-2,4-pentanediol | 5 | 28.5 |
| mp. B | — | — | >100 |

EXAMPLE 3

The procedure of Example 1 was repeated using esel fuel that contained 96 ppm of metal. The results tained are set forth in Table III.

TABLE III

| | Stabilization of Diesel Fuel Containing 96 ppm of Metal | | | |
|---|---|---|---|---|
| | | Stabilizer | | |
| | Metal Content of Diesel Fuel | Alcohol | Amount of Alcohol (% by Volume) | Gum Formation (mg./100 ml.) |
| | 64 ppm Mn 32 ppm Cu | Ethanol | 5 | 15.0 |
| mp. C | 64 ppm Mn 32 ppm Cu | — | — | 82.0 |
| | 96 ppm Bi | Ethanol | 5 | 0.5 |
| mp. D | 96 ppm Bi | — | — | >100 |

From the data in Tables I, II, and III, it will be seen that the alcohol stabilizers substantially reduced the amount of insoluble gum formed when the metal-containing diesel fuels were heated in the presence of oxygen.

Each of the other alkanols and glycols disclosed herein can be used in a similar way to inhibit the formation of insoluble gums in metal-containing hydrocarbon fuel compositions that are subject to oxidative conditions.

What is claimed is:

1. A diesel fuel composition stabilized against oxidative deterioration that consists essentially of diesel fuel containing from 5 ppm to 500 ppm of copper and from 1% to 25% by volume of a stabilizer selected from the group consisting of alkanols having from 1 to 10 carbon atoms, glycols having from 2 to 9 carbon atoms, and mixtures thereof.

2. A stabilized diesel fuel composition as defined in claim 1 that contains from 30 ppm to 100 ppm of copper and from 2% to 10% by volume of said stabilizer.

3. A stabilized diesel fuel composition as defined in claim 1 wherein the stabilizer is an alkanol having 1 to 4 carbon atoms.

4. A stabilized diesel fuel composition as defined in claim 1 wherein the stabilizer is ethanol.

5. A process for stabilizing diesel fuel against oxidative deterioration that consists of incorporating a stabilizer into a fuel composition consisting essentially of diesel fuel and from 5 ppm to 500 ppm of copper, said stabilizer selected from the group consisting of alkanols having from 1 to 10 carbon atoms, glycols having from 2 to 9 carbon atoms and mixtures thereof and being incorporated in amounts from 1% to 25% by volume based on the volume of said composition.

6. The process of claim 5 wherein from 2% to 10% by volume of said stabilizer is incorporated in a fuel composition that contains from 30 ppm to 100 ppm of copper.

7. The process of claim 5 wherein the stabilizer is an alkanol having 1 to 4 carbon atoms.

8. The process of claim 5 wherein the stabilizer is ethanol.

9. The process of claim 5 wherein the stabilizer is methanol.

10. The process of claim 5 wherein the stabilizer is a glycol having 4 to 8 carbon atoms.

* * * * *